US009470391B2

(12) United States Patent
Itagaki

(10) Patent No.: US 9,470,391 B2
(45) Date of Patent: Oct. 18, 2016

(54) LED LIGHT SOURCE MODULE

(75) Inventor: Nobutaka Itagaki, Tokyo (JP)

(73) Assignee: OSRAM GmbH, Munich (DE)

( * ) Notice: Subject to any disclaimer, the term of this patent is extended or adjusted under 35 U.S.C. 154(b) by 134 days.

(21) Appl. No.: 14/358,052

(22) PCT Filed: Nov. 17, 2011

(86) PCT No.: PCT/EP2011/070347

§ 371 (c)(1),
(2), (4) Date: May 14, 2014

(87) PCT Pub. No.: WO2013/071972

PCT Pub. Date: May 23, 2013

(65) Prior Publication Data

US 2014/0328079 A1 Nov. 6, 2014

(51) Int. Cl.

| | |
|---|---|
| ***F21V 29/00*** | (2015.01) |
| ***F21S 8/10*** | (2006.01) |
| ***F21V 29/60*** | (2015.01) |
| ***F21V 29/02*** | (2006.01) |
| ***F21K 99/00*** | (2016.01) |
| ***F21V 29/80*** | (2015.01) |

(Continued)

(52) U.S. Cl.

CPC ..... *F21S 48/323* (2013.01); *F21K 9/13* (2013.01); *F21S 48/1109* (2013.01); *F21S 48/1154* (2013.01); *F21S 48/1159* (2013.01); *F21S 48/212* (2013.01); *F21S 48/215* (2013.01); *F21S 48/321* (2013.01); *F21S 48/325* (2013.01); *F21V 29/02* (2013.01); *F21V 29/20* (2013.01); *F21V 29/60* (2015.01); *F21V 29/80* (2015.01); *F21V 29/67* (2015.01); *F21Y 2101/02* (2013.01)

(58) Field of Classification Search

CPC .. F21V 29/20; F21V 29/2212; F21V 29/508; F21V 29/503; F21V 29/60–29/677; F21S 48/21–48/215; F21S 48/32–48/325

See application file for complete search history.

(56) References Cited

U.S. PATENT DOCUMENTS

| | | | |
|---|---|---|---|
| 7,762,700 | B2 | 7/2010 | Luo et al. |
| 8,066,414 | B2 | 11/2011 | Pabst et al. |

(Continued)

FOREIGN PATENT DOCUMENTS

| | | | |
|---|---|---|---|
| DE | 102007040444 | A1 | 3/2009 |
| DE | 102007041817 | A1 | 3/2009 |

(Continued)

OTHER PUBLICATIONS

English abstract of JP 2010262903 A of Nov. 18, 2010.

(Continued)

*Primary Examiner* — Mariceli Santiago

(74) *Attorney, Agent, or Firm* — Viering, Jentschura & Partner mbB

(57) ABSTRACT

An LED light source module is disclosed, which can replace a halogen bulb. The LED light source module includes an LED light source, a heat sink, an electric fan unit, a driver circuit, and an attachment, and all of these constituent elements are integrated. A structure of the attachment is the same as that of an attachment of a halogen bulb generally used as a light source of a lighting apparatus for a vehicle. The LED light source module can replace a halogen bulb. When the LED light source module needs replacement, unlike the conventional LED head light where the whole lamp main body is replaced, only the LED light source module can be replaced.

6 Claims, 10 Drawing Sheets

(51) Int. Cl.
*F21V 29/67* (2015.01)
*F21Y 101/02* (2006.01)

(56) References Cited

U.S. PATENT DOCUMENTS

| | | | | |
|---|---|---|---|---|
| 8,186,849 | B2 | 5/2012 | Helbig et al. | |
| 2009/0154180 | A1* | 6/2009 | Cho et al. | 362/459 |
| 2009/0316425 | A1* | 12/2009 | Inoue et al. | 362/547 |
| 2010/0027270 | A1 | 2/2010 | Huang et al. | |
| 2010/0244649 | A1* | 9/2010 | Inaba | 313/46 |
| 2010/0253223 | A1* | 10/2010 | Inoue et al. | 315/82 |
| 2012/0314436 | A1* | 12/2012 | Inoue et al. | 362/487 |
| 2013/0140986 | A1* | 6/2013 | Tsukamoto | 315/77 |
| 2013/0201706 | A1* | 8/2013 | Suzuki et al. | 362/487 |
| 2014/0140085 | A1* | 5/2014 | Matsumoto | 362/516 |

FOREIGN PATENT DOCUMENTS

| | | | |
|---|---|---|---|
| DE | 102009022723 | A1 | 12/2009 |
| EP | 1371901 | A2 | 12/2003 |
| JP | 2008198478 | A | 8/2008 |
| JP | 2010262903 | A | 11/2010 |
| WO | 2009040703 | A2 | 4/2009 |
| WO | 2010032143 | A1 | 3/2010 |

OTHER PUBLICATIONS

English abstract of JP 2008198478 A of Aug. 28, 2008.
International Search Report issued in the corresponding PCT application No. PCT/EP2011/070347, dated May 16, 2012.

* cited by examiner

LED LIGHT SOURCE MODULE

RELATED APPLICATION

The present application is a national stage entry according to 35 U.S.C. §371 of PCT application No.: PCT/EP2011/070347 filed on Nov. 17, 2011, and is incorporated herein by reference in its entirety.

TECHNICAL FIELD

Various embodiments relate to an LED (light emitting diode) light source module for a lighting apparatus for a vehicle.

BACKGROUND

Typically, a current vehicle head light uses a halogen bulb as a light source. Hereafter, it is thought that employment of a head light (also called LED head light using LED as a light source will progress, but when an internal temperature (junction temperature) of the LED approaches a maximum junction temperature of the LED due to self-heating, such a drawback as reduction in light flux, change in emission color, reduction of luminance, or shortening of an operating life occurs. Therefore, a strict heat control is required.

As a conventional LED head light, an arrangement in which a heat sink is provided on a supporting body of an LED and an electric fan is arranged to face the heat sink is known. In such an LED head light, the LED is forcibly cooled by forcibly circulating air within a lighting chamber with the electric fan to promote a dissipation of heat from the heat sink. (See JP Patent Appl. Publ. No. 2010-262903)

The following is a list of the aforementioned background art:

JP Patent Appl. Publ. No. 2010-262903

However, since the conventional LED head light disclosed in JP Patent Appl. Publ. No. 2010-262903 is configured such that an LED light source is integrated with a lighting apparatus main body, when the necessity of replacement of the LED light source arises, the LED head light itself must be replaced.

SUMMARY

Various embodiments provide an LED light source module which can replace a halogen bulb or the like generally used as a light source for a lighting apparatus for a vehicle.

[Configuration 1]

An LED light source module of the present disclosure is a replaceable light source module for a lighting apparatus for a vehicle, including:

an LED light source having a single or a plurality of LED chips;

a heat sink thermally connected to the LED light source;

an electric fan unit cooling the heat sink by air blasting;

a driver circuit driving the LED light source and the electric fan unit; and an attachment detachably fitted into a light source mounting hole of a lighting apparatus for a vehicle, wherein all of the LED light source, the heat sink, the electric fan unit, the driver circuit, and the attachment are configured integrally, the LED light source is directly mounted on the heat sink, the heat sink is provided between the LED light source and the electric fan unit, the attachment has a supporting frame projecting into a lighting chamber of the lighting apparatus for a vehicle, the electric fan unit is provided at a distal end portion of the supporting frame, the driver circuit is provided on the supporting frame, and all of the LED light source, the heat sink, the electric fan unit, and the driver circuit are housed in the lighting chamber of the lighting apparatus for a vehicle through the light source mounting hole.

The LED light source module configured in the above manner can replace a halogen bulb or the like when the LED light source module has the same attachment structure as that of the halogen bulb or the like generally used as a light source for a lighting apparatus for a vehicle. When the LED light source module needs replacement, unlike the conventional case where the whole arrangement is replaced, only the LED light source module can be replaced.

Since the LED light source module is configured such that the LED light source is directly mounted on the heat sink, a heat exchange between the LED light source and the heat sink can be performed with high efficiency. Therefore, the LED light source can be cooled efficiently by cooling the heat sink with air flowing from the electric fan unit. Accordingly, the LED light source module with a compact and inexpensive configuration can be realized by using an electric fan unit with a relatively small total amount of air.

[Configuration 2]

The LED light source module according to Configuration 1, wherein the heat sink and the driver circuit are adjacent to each other, and the heat sink has an internal flow passage designed such that air or any other suited gaseous cooling medium supplied from the electric fan unit can be guided to the driver circuit.

[Configuration 3]

The LED light source module according to Configuration 1, wherein a stacking direction of the LED light source, the heat sink, and the electric fan unit is a diametrical direction of the attachment, i.e., a diametrical direction of the light source mounting hole.

[Configuration 4]

The LED light source module according to any one of Configurations 1 to 3, wherein the LED light source has a substrate joined to the heat sink, the substrate has a first mounting surface and a second mounting surface, the first mounting surface and the second mounting surface are different from each other in distance from the heat sink, a first LED chip is mounted on the first mounting surface, and a second LED chip is mounted on the second mounting surface.

[Configuration 5]

The LED light source module according to any one of Configurations 1 to 3, wherein the LED light source has a substrate joined to the heat sink, the substrate has a first mounting surface and a second mounting surface, the first mounting surface is inclined toward the second mounting surface, a first LED chip is mounted on the first mounting surface, and a second LED chip is mounted on the second mounting surface.

[Configuration 6]

The LED light source module according to any one of Configurations 1 to 3, wherein the heat sink is provided on both sides of the electric fan unit, and the LED light source is directly mounted on each of the heat sinks.

[Configuration 7]

The LED light source module according to any one of Configurations 1 to 3, wherein the attachment has a gasket for sealing the light source mounting hole.

According to the present disclosure, a replaceable LED light source module can be realized.

The LED light source module of the present disclosure can replace a halogen bulb or the like when the LED light source module has the same attachment structure as that of the halo gen bulb or the like generally used as a light source for a lighting apparatus for a vehicle.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

First Embodiment

Figure 1:
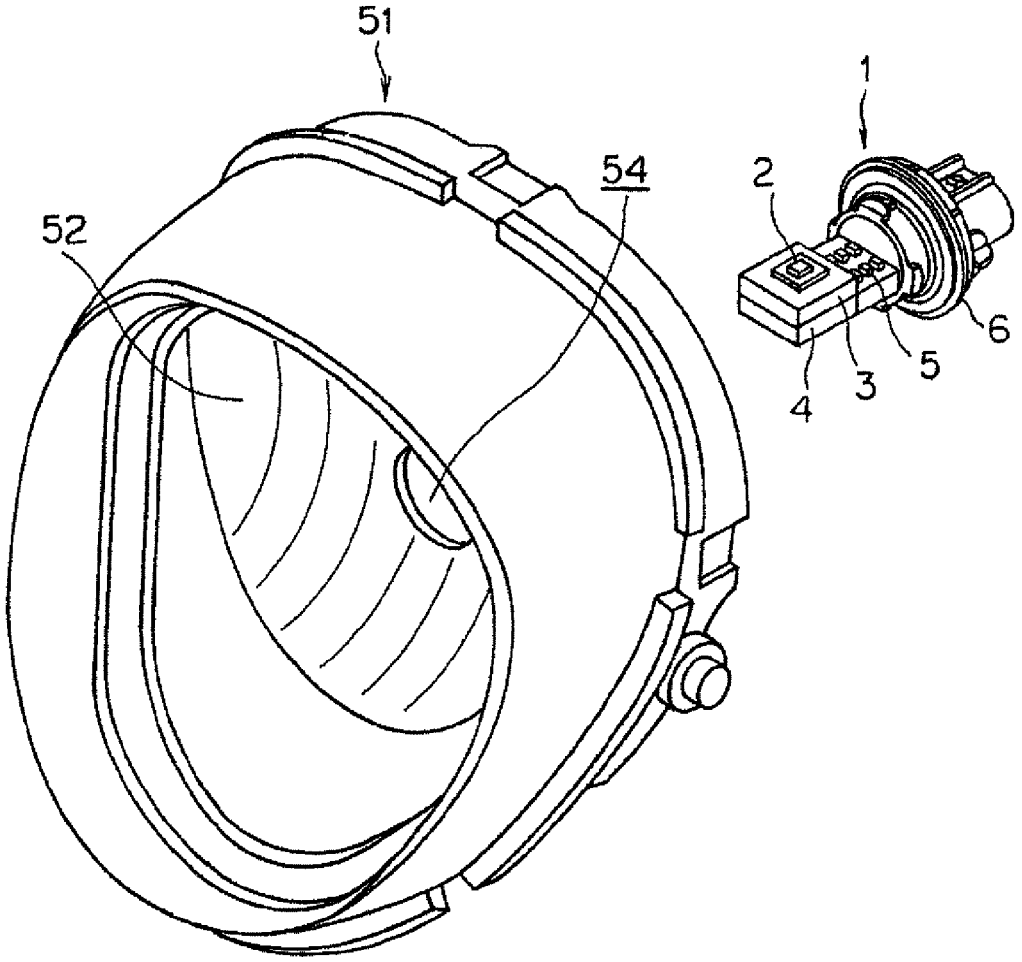
FIG. 1 is a perspective view illustrating an LED light source module of the present disclosure and a head light which can use this LED light source module as a light source.
Figure 2:
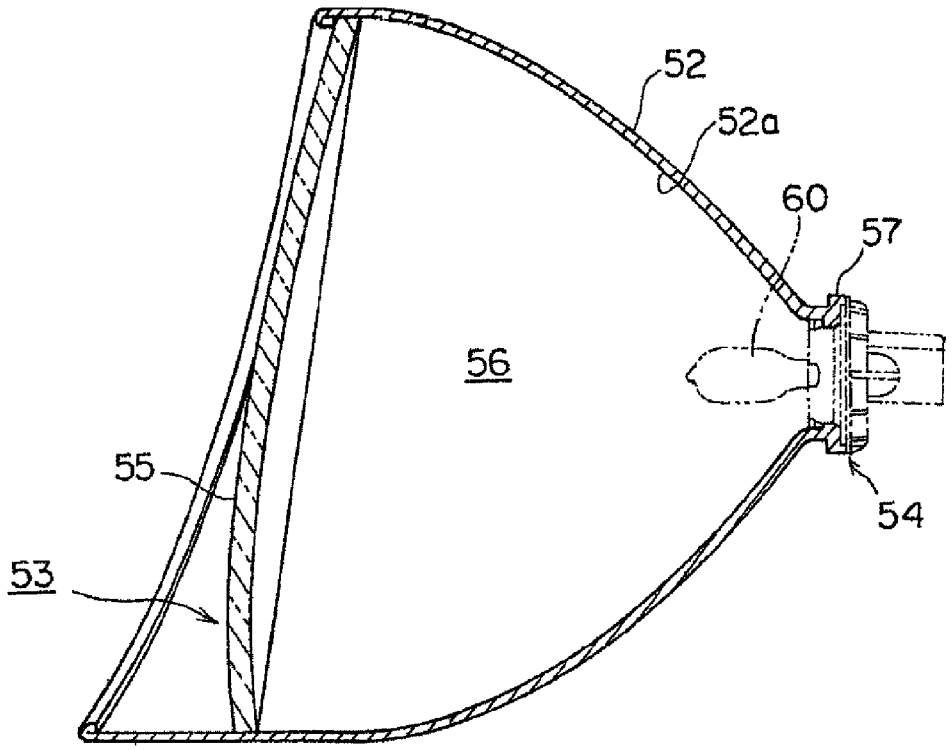
FIG. 2 is a schematic sectional view showing an internal structure of the head light.

FIG. 1 shows a head light 51 and an LED light source module 1 of the present disclosure. FIG. 2 shows an internal structure of the head light 51.

The head light 51 illustrated in FIG. 1 is a general type of lamp using a halogen bulb as a light source.

As shown in FIG. 2, the head light 51 has a reflector 52.

The reflector 52 has a largely-opened light emitting opening 53 at a front end thereof. The light emitting opening 53 is fitted with a lens 55. The entire inner surface of the reflector 52 constitutes a reflecting surface. A rear end portion of the reflector 52 is curved in a dome shape, and light emitted from a halogen bulb (light source module) 60 is reflected and guided forward by a reflecting surface 52*a* of the curved portion. A light source mounting hole 54 for mounting the halogen bulb (light source module) 60 is provided at a central portion of the rear end portion of the reflector 52. A fitting portion 57 for detachably mounting the halogen bulb (light source module) 60 is formed at the light source mounting hole 54.

Figure 3:
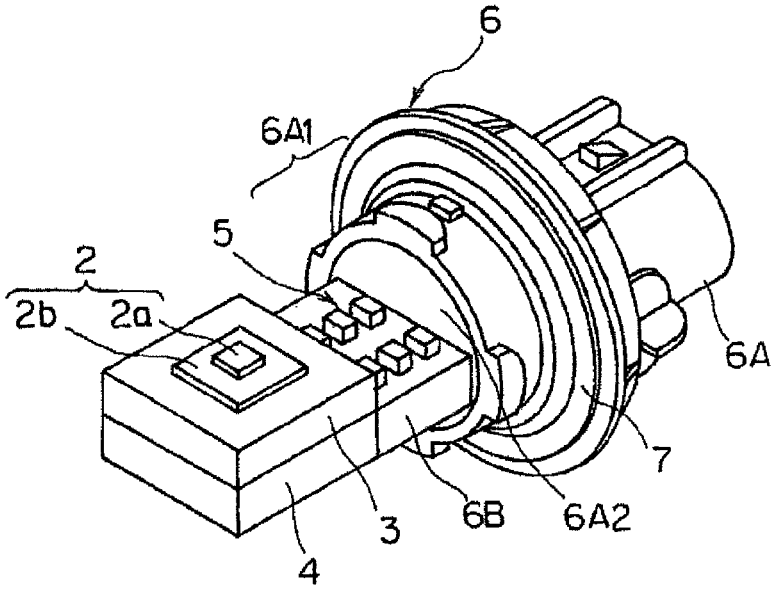
FIG. 3 is a perspective view showing a first embodiment of the LED light source module of the present disclosure.
Figure 4:
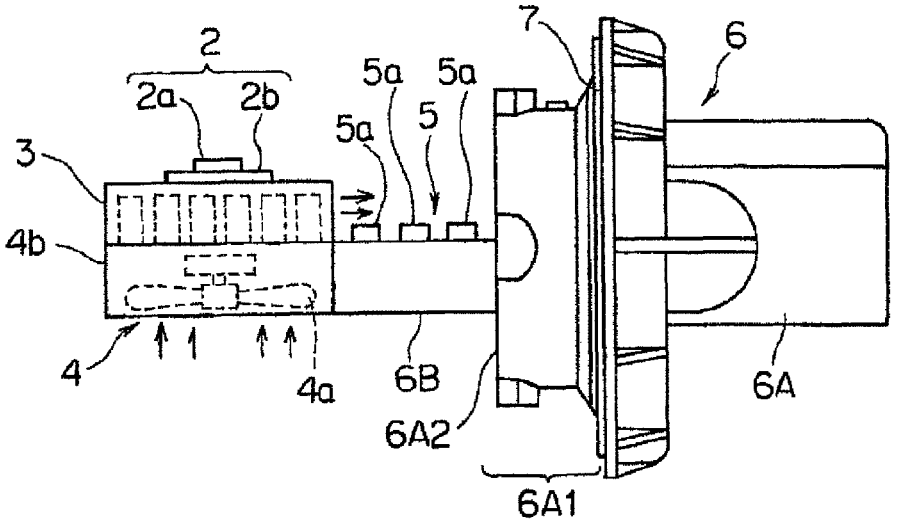
FIG. 4 is a side view of the LED light source module shown in FIG. 3.

As shown in FIGS. 3 and 4, the LED light source module 1 has an LED light source 2, a heat sink 3, an electric fan unit 4, a driver circuit 5, and an attachment 6, and all of these constituent elements are integrated.

The LED light source 2 is directly mounted on the heat sink 3. The LED light source 2 is composed of a single or a plurality of LED chips 2*a*, and an LED supporting portion 2*b* which supports the LED chip 2*a*. The LED light source 2 has an emission performance of at least 350 lm, preferably about 2000 lm.

The heat sink 3 is arranged between the LED light source 2 and the electric fan unit 4.

Figure 6:
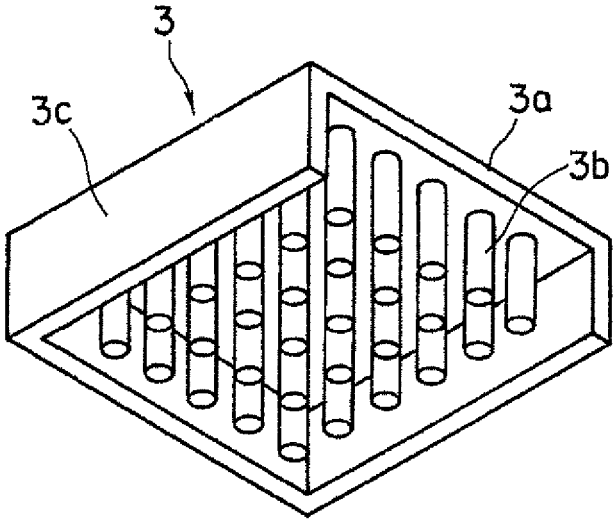
FIG. 6 is a perspective view of a heat sink.

As shown in FIG. 6, the heat sink 3 has a flat plate portion 3*a*, a plurality of fins 3*b*, and side plate portions 3*c* surrounding the fins 3*b*. The shape of the flat plate portion 3*a* is roughly square. The LED light source 2 is directly mounted on a surface of the flat plate portion 3*a*. The fins 3*b* are projected perpendicularly from the back surface of the flat plate portion 3*a*. The fins 3*b* are arranged in a grid shape. The side plate portions 3*c* are provided along three of four sides of the flat plate portion 3*a*.

The electric fan unit 4 includes a fan 4*a* within a casing body 4*b* thereof. The amount of air of the fan 4*a* is selected on the basis of measurement results of an amount of heat generation of the LED light source 2, a thermal resistance of the heat sink 3, or the like. A space with a sufficient capacity is provided in the casing body 4*b* for good air suction and air blasting by the fan 4*a*. The electric fan unit 4 has an air blasting performance by which the junction temperature of the LED light source 2 with an emission performance of 350 lm or more can be kept at or below a reference temperature (about 150° C.) at which the LED light source 2 can operate stably.

The driver circuit 5 is to drive the LED light source 2 and the electric fan unit 4. The driver circuit 5 is composed of various electronic components 5*a*. Further, the driver circuit 5 is electrically connected to the LED light source 2 and the electric fan unit 4.

The attachment 6 has an attachment main body 6A and a supporting frame 6B.

The attachment main body 6A is detachably fitted into the light source mounting hole 54 of the head light 51. A structure of a portion 6A1 of the attachment main body GA fitted into the light source mounting hole 54 is the same as that of an attachment portion of the halogen bulb (light source module) 60. An O-ring (gasket) 7 for air-tightly sealing a space between the attachment main body 6A and the fitting portion 57 of the light source mounting hole 54 is provided on the portion 6A1.

Figure 5:
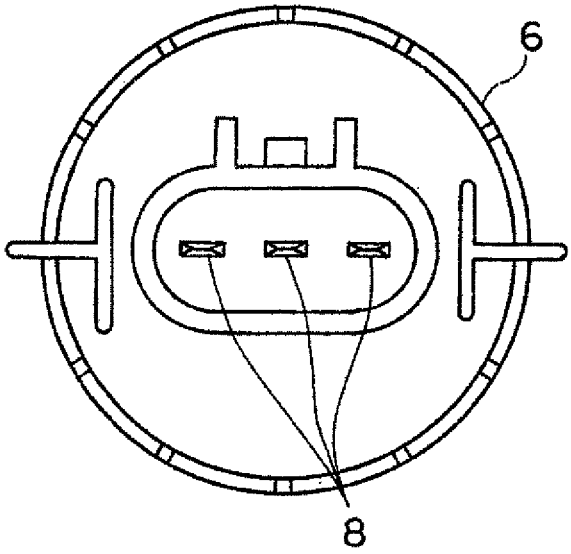
FIG. 5 is a rear view of the LED light source module shown in FIG. 3.

The supporting frame GE projects from a front end 6A2 of the attachment main body 6A into the lighting chamber 56 of the head light 51 when the attachment main body 6A is fitted into the light source mounting hole 54 of the head light 51. The attachment main body 6A has power plugs 8 and signal terminals (not shown) (see FIG. 5).

The electric fan unit 4 is provided at a distal end portion of the supporting frame 6B. The driver circuit 5 is provided on the supporting frame 6B and located between the heat sink 3 and the attachment main body 6A. The heat sink 3 is fixed onto the casing body 4*b* of the electric fan unit 4 such that an end portion of the heat sink 3 not provided with the side plate portion 3*c* faces the driver circuit 5. The side plate portions 3*c* of the heat sink 3 are joined airtight to the casing body 4*b* of the electric fan unit 4. With this configuration, the air flowing from the electric fan unit 4 flows into a space surrounded by the flat plate portion 3*a* and the side plate portions 3*c* of the heat sink 3 so as to be used to cool the LED light source 2 through heat exchanges with the fins 3*b* and the side plate portions 3*c*, and is then guided to the driver circuit 5.

The attachment main body 6A has the largest diameter of the constituent elements of the LED light source module 1. A stacking direction of the LED light source 2, the heat sink 3, and the electric fan unit 4 is a diametrical direction of the portion 6A1 of the attachment main body 6A fitted into the light source mounting hole 54, i.e., a diametrical direction of the light source mounting hole 54.

Figure 7:
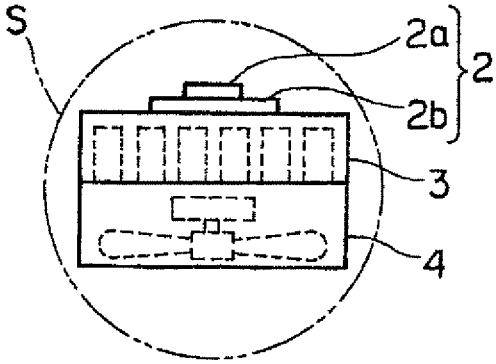
FIG. 7 is an explanatory view showing that an LED light source, a heat sink, an electric fan unit, and a driver circuit are all within a projection plane viewed in an insertion direction of an attachment into a light source mounting hole.
Figure 8:
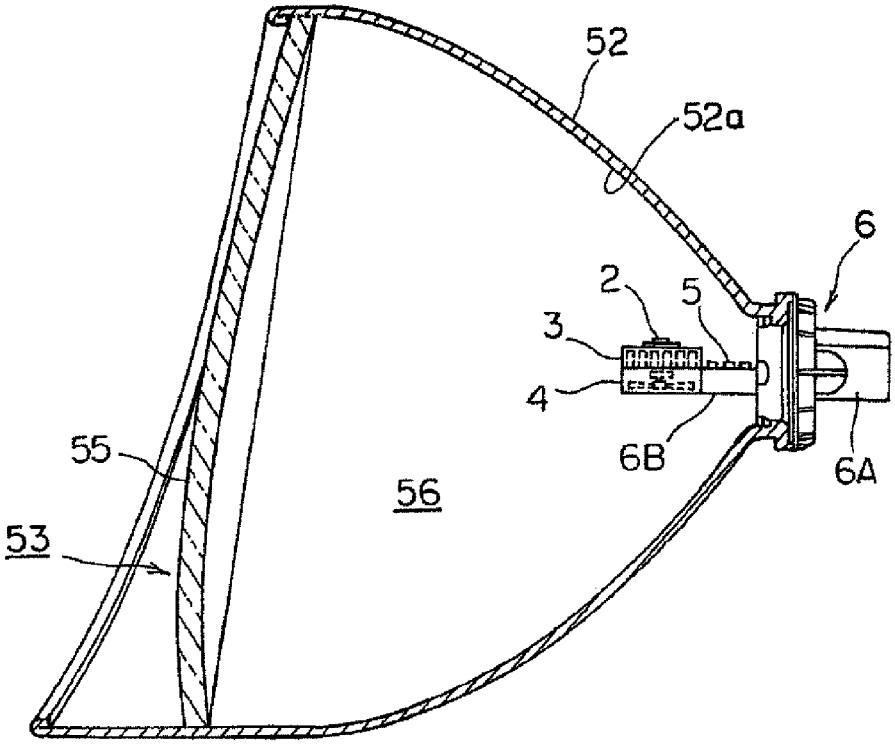
FIG. 8 is a sectional view showing a state in which the LED light source module shown in FIG. 3 has been mounted on a head light main body.

As shown in FIG. 7, the LED light source module 1 is designed such that the LED light source 2, the heat sink 3, the electric fan unit 4, and the driver circuit 5 are all within a projection plane S viewed in an insertion direction of the portion 6A1 into the light source mounting hole 54. Specifically, as shown in FIG. 8, the LED light source module 1 is configured such that the LED light source 2, the heat sink 3, the electric fan unit 4, and the driver circuit 5 can all be housed in the lighting chamber 56 through the light source mounting hole 54. Sizes, shapes, and arrangements of these constituent elements are selected such that when the attachment main body 6A is attached rightly to the light source mounting hole 54, the LED light source 2 is accurately located with respect to the reflecting surface 52*a* of the reflector 52.

As described above, in the LED light source module 1 of this embodiment, (1) the LED light source 2, the heat sink 3, the electric fan unit 4, the driver circuit 5, and the attachment 6, all of which are constituent elements of the LED light source module 1, are integrated, (2) the structure of the portion 6A1 of the attachment main body 6A fitted into the light source mounting hole 54 has the same structure as that of the attachment portion of the halo gen bulb (light source module) 60, (3) the LED light source 2, the heat sink 3, the electric fan unit 4, and the driver circuit 5 are designed such that they are all within the projection plane viewed in the insertion direction of the portion 6A1 into the light source mounting hole 54, and (4) the sizes, shapes, and arrangements of these constituent elements are selected such that the LED light source 2 is accurately located and arranged with respect to the reflecting surface 52*a* of the reflector 52.

The LED light source module 1 can replace a halogen bulb. The use of the LED light source module 1 instead of the halogen bulb can realize the LED head light.

When the LED light source module 1 needs replacement, unlike the conventional case where the whole head light is replaced, only the LED light source module 1 can be replaced. Further, the LED light source module 1, which is simple in configuration, can be provided at low costs.

Therefore, by using the LED light source module 1 as a light source of a head light, costs can be significantly reduced compared to the conventional LED head light in which only a light source portion using an LED cannot be replaced. Further, since the light source portion is detachable, maintainability of the LED head light can be significantly improved. The LED light source module 1 can be distributed in a market where it is sold as a portion of a vehicle equipped with an LED head light as well as a replacement part of a vehicle having been sold. Further, the LED light source module 1 can be used as a head light not only for a four-wheel vehicle but also for a two-wheel vehicle.

Further, the LED light source module 1 does not need a heat exhausting system separately since it has the heat sink 3 for removing heat from the LED light source 2 and the electric fan unit 4 for cooling the heat sink 3 as means for forcibly cooling the LED light source 2. The electric fan unit 4 can maintain the junction temperature of the LED light source 2 having an emission performance of 350 lm or more at or below a reference temperature (about 150° C.) at which the LED light source 2 can operate stably. Accordingly, the LED light source module 1, although replaceable, can provide an emission performance of 350 lm or more which is required per head light with a single module.

Further, in this embodiment, (5) the heat sink 3 and the driver circuit 5 are provided adjacent to each other, and (6) the heat sink 3 is structurally designed such that the air supplied from the electric fan unit 4 to the heat sink 3 can be guided to the driver circuit 5. With this configuration, the air supplied from the electric fan unit 4 can be utilized effectively to cool the LED light source 2 as well as the driver circuit 5. Cooling the driver circuit 5 allows employing such a simple and inexpensive circuit configuration as a linear IC or resistance bridge.

With the LED light source module 1, the amount of light of at least 350 lm required per head light of a vehicle can be satisfied by a single light source module. Therefore, it is not necessary to combine a plurality of light source modules in designing a head light so as to satisfy the required amount of light. Using the LED light source module 1 as a general-purpose light source for a head light eliminates the need for individually designing head lights depending on types of vehicles.

Second Embodiment

Figure 9:
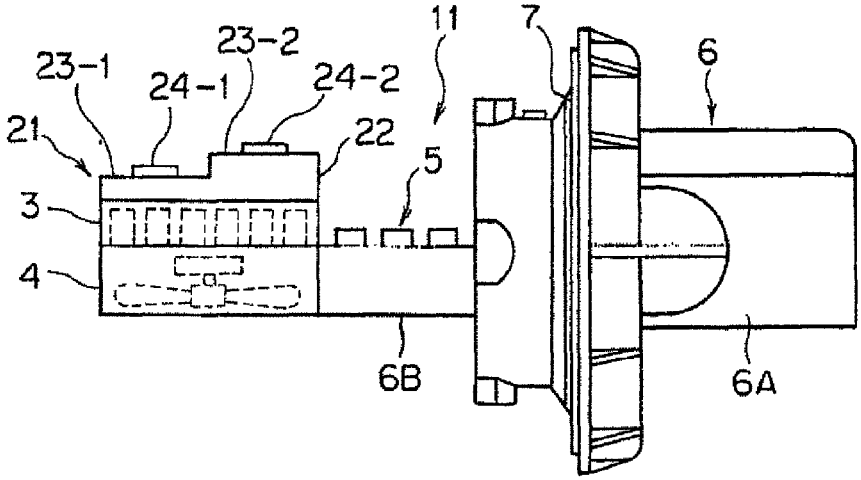
FIG. 9 is a side view showing a second embodiment of the LED light source module of the present disclosure.

FIG. 9 shows a second embodiment of the LED light source module of the present disclosure. An LED light source 21 of an LED light source module 11 shown in FIG. 9 has a substrate 22 joined to the heat sink 3. The substrate 22 is formed of a material excellent in thermal conductivity, such as aluminum alloy, carbon material, molybdenum, copper, or silver. The substrate 22 has a first mounting surface 23-1 and a second mounting surface 23-2. The first mounting surface 23-1 and the second mounting surface 23-2 are different from each other in distance from the heat sink 3. The anteriorly-located first mounting surface 23-1 is formed shorter than the second mounting surface 23-2. A first LED chip 24-1 is mounted on the first mounting surface 23-1. A second LED chip 24-2 is mounted on the second mounting surface 23-2.

One of the first LED chip 24-1 and the second LED chip 24-2 is an LED chip for producing high beam, and the other is for low beam. The first and second LED chips 24-1 and 24-2 are each composed of a single or a plurality of light-emitting elements.

Third Embodiment

Figure 10:
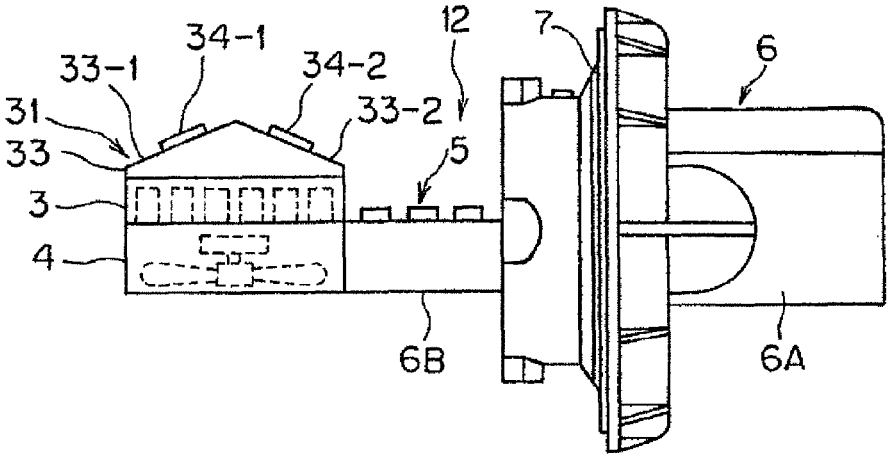
FIG. 10 is a side view showing a third embodiment of the LED light source module of the present disclosure.

FIG. 10 shows a third embodiment of the LED light source module according to the present disclosure.

An LED light source 31 of an LED light source module 12 shown in FIG. 10 has a substrate 33 joined to the heat sink 3. The substrate 33 is formed of a material excellent in thermal conductivity, such as aluminum alloy, carbon material, molybdenum, copper, or silver. The substrate 33 has a first mounting surface 33-1 and a second mounting surface 33-2. The first mounting surface 33-1 and the second mounting surface 33-2 are inclined toward each other to constitute a triangular roof-shaped mounting surface including a boundary between the ridge lines. A first LED chip 34-1 is mounted on the first mounting surface 33-1. A second LED chip 34-2 is mounted on the second mounting surface 33-2. One of the first LED chip 34-1 and the second LED chip 34-2 is an LED chip for producing high beam, and the other is for low beam. The first and second LED chips 34-1 and 34-2 are each composed of a single or a plurality of light-emitting elements.

Fourth Embodiment

Figure 11:
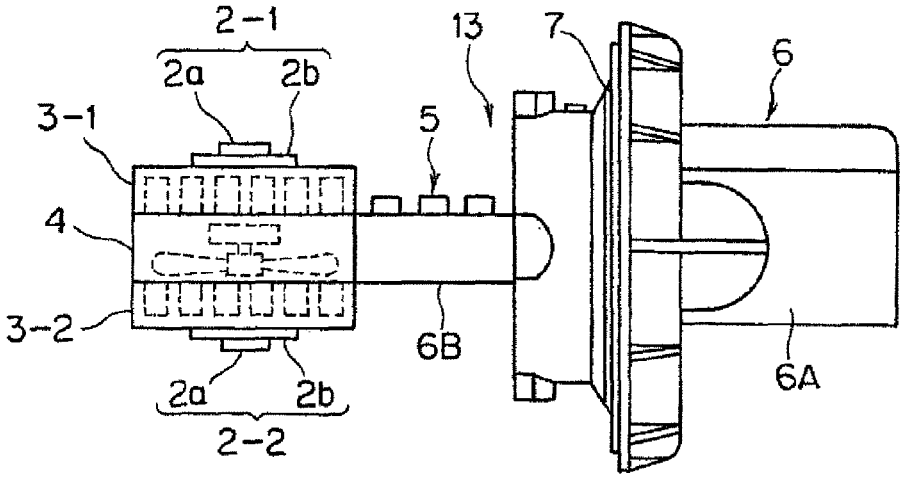
FIG. 11 is a side view showing a fourth embodiment of the LED light source module of the present disclosure.

FIG. 11 shows a fourth embodiment of the LED light source module according to the present disclosure.

An LED light source module 13 shown in FIG. 11 includes first and second heat sinks 3-1 and 3-2 disposed on both upper and lower sides of the electric fan unit 4. A first LED light source 2-1 is directly mounted on the first heat sink 3-1, and a second LED light source 2-2 is directly mounted on the second heat sink 3-2. One of the first LED chip 2-1 and the second LED chip 2-2 is a light source for producing high beam, and the other is for low beam.

Fifth Embodiment

Figure 12:
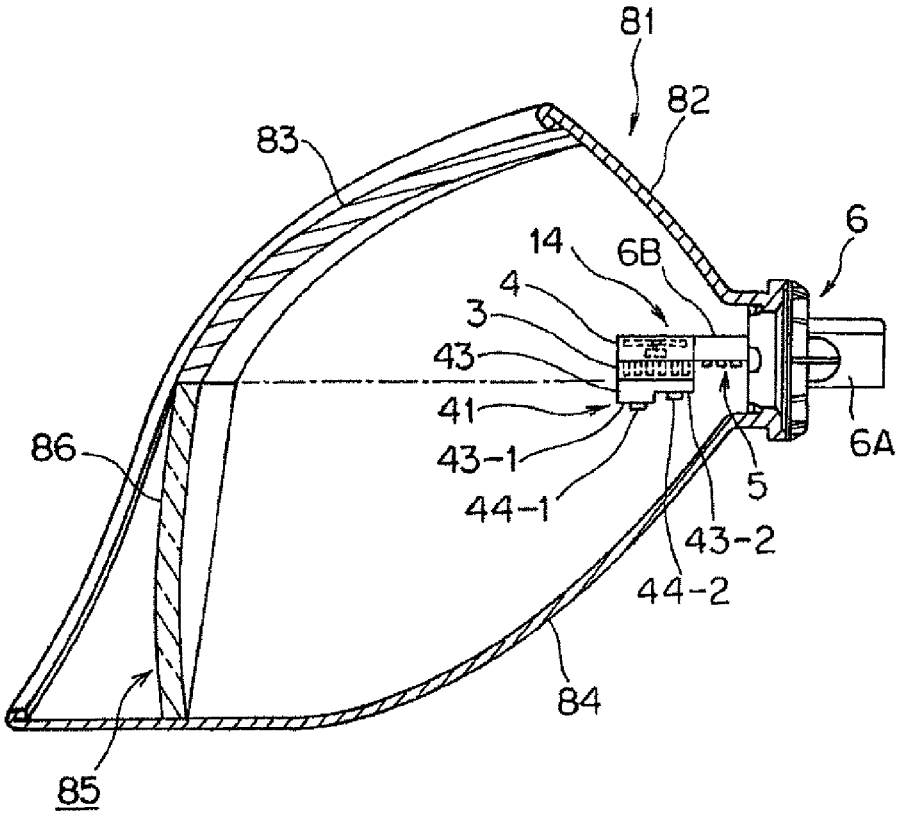
FIG. 12 is a sectional view showing a state in which the LED light source module according to a fifth embodiment of the present disclosure has been mounted on a head light main body.

FIG. 12 shows a fifth embodiment of the LED light source module according to the present disclosure.

An LED light source 41 of an LED light source module 14 shown in FIG. 12 has a substrate 43 joined to the heat sink 3. The substrate 43 is formed of a material excellent in thermal conductivity, such as aluminum alloy, carbon material, molybdenum, copper, or silver. The substrate 43 has a first mounting surface 43-1 and a second mounting surface 43-2. The first mounting surface 43-1 and the second mounting surface 43-2 are different from each other in distance from the heat sink 3. The anteriorly-located first mounting surface 43-1 is formed taller than the second mounting surface 43-2. A first LED chip 44-1 is mounted on the first mounting surface 43-1. A second LED chip 44-2 is mounted on the second mounting surface 43-2. One of the first LED chip 44-1 and the second LED chip 44-2 is an LED chip for producing high beam, and the other is for low beam. The first and second LED chips 44-1 and 44-2 are each composed of a single or a plurality of light-emitting elements.

An upper side portion of a head light 81 shown in FIG. 12 is composed of an inner frame 82 and an opaque outer cover 83 covering a portion ahead of the inner frame 82. A reflector is curved in the shape of a concave sphere and extends forward from a lower end of the inner frame 82. A light emitting opening 85 is defined between a front end of the reflector 84 and the outer cover 83, and a transparent lens 86 is attached to the light emitting opening 85. The LED light source module 14 is attached to the head light 81 with the first LED chip 44-1 and the second LED chip 44-2 oriented downward, i.e., facing the reflector 84. The heat sink 3 and the electric fan unit 4 are invisible from the outside of the head light 81 since they are located behind the outer cover 83.

Figure 13:
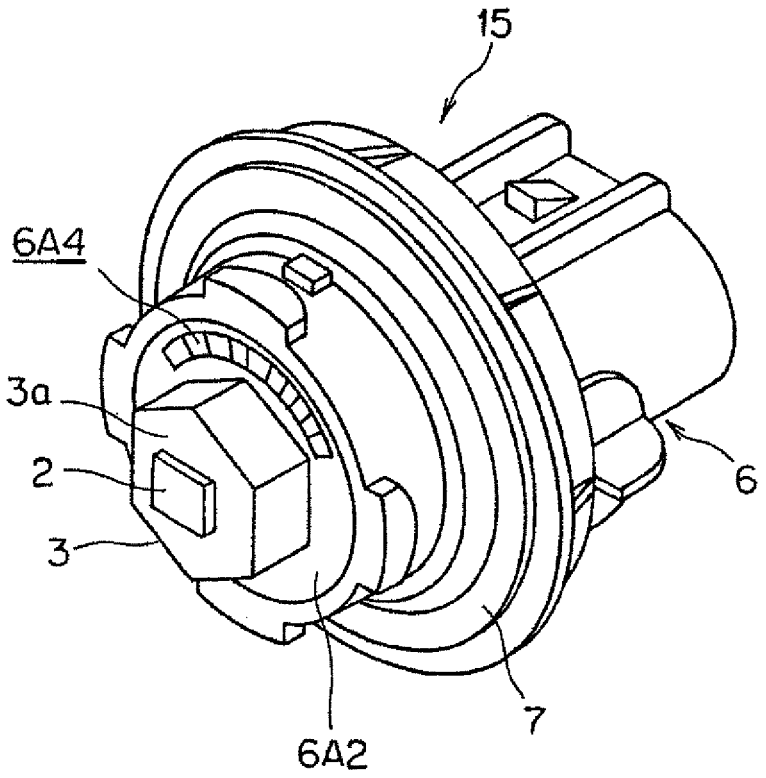
FIG. 13 is a perspective view showing another embodiment of the LED light source module of the present disclosure.
Figure 14:
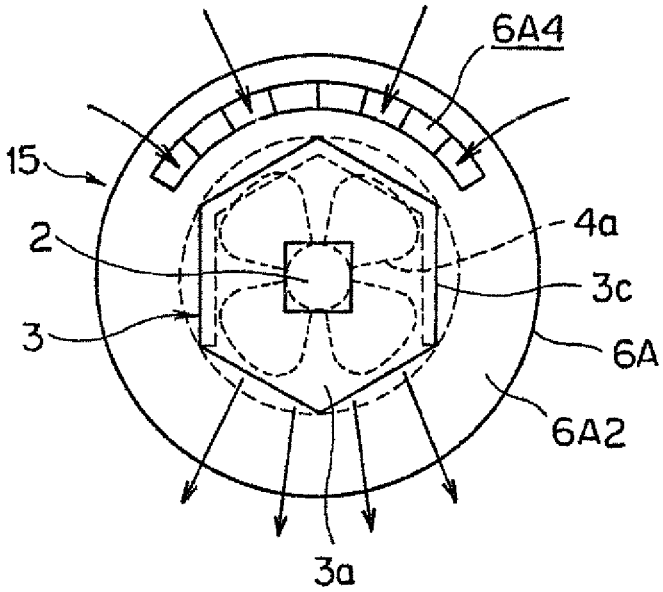
FIG. 14 is a front view of the LED light source module shown in FIG. 13.
Figure 15:
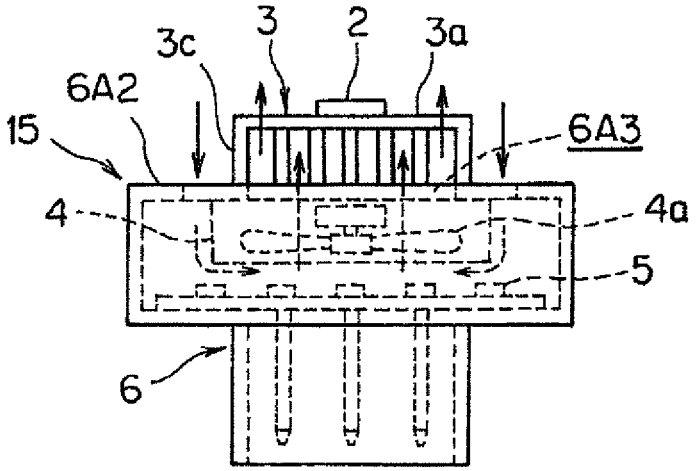
FIG. 15 is a sectional view of the LED light source module shown in FIG. 13.

The present disclosure is not limited to the above-described embodiments, and the shapes or sizes of the respective portions, or specific configurations of the respective elements can be changed appropriately. For example, the above-described embodiments show that the shape of the flat plate portion 3*a* of the heat sink 3 is roughly square, but it is not limited to such a shape but may be rectangular or circular. Further, the stacking direction of the LED light source 2, the heat sink 3, and the electric fan unit 4 may be an insertion direction of the attachment main body 6A into the light source mounting hole 54. In this case, the LED light source 2 is provided to directly face the light emitting opening 53 of the head light 81. An LED light source module 15 illustrated in FIGS. 13 to 15 includes the electric fan unit 4 and the driver circuit 5 inside the attachment main body 6A. The shape of the flat plate portion 3*a* of the heat sink 3 is hexagonal. The side plate portion 3*c* is provided along four of six sides of the flat plate portion 3*a*. An air blasting port 6A3 and air intake ports 6A4 are formed in a front end 6A2 of the attachment main body 6A. The air blasting port 6A3 is formed in a central portion of the front end 6A2 of the attachment main body 6A. The electric fan unit 4 is attached to the air blasting port 6A3. The air intake ports 6A4 are provided in an arc shape along a peripheral edge of the front end 6A2 of the attachment main body 6A. When the electric fan unit 4 is driven, air in the lighting chamber 56 flows from the air intake ports 6A4 into the attachment main body 6A. After being used to cool the driver circuit 5, the air flows into the heat sink 3 through the air blasting port 6A3. This air cools the heat sink 3 as well as the LED light source 2 via the heat sink 3.

Additionally, in the above-described embodiments, only replaceability with a halogen bulb has been described, but it is possible to provide replaceability with an HID bulb or other light bulbs as long as the attachment structure is re placeable.

Further, in the above-described embodiments, the example where the LED light source module of the present disclosure is applied to the light source of the head light has been described, but the LED light source module of the present disclosure can be applied also as a light source for a signal light.

The LED chips may be super luminescent diode chips or solid state light emitters with a quasi-monochromatic emission spectrum (for example emitting a color like red, green, blue, or radiation in the Ultraviolet or Infrared wavelength range) or solid state light emitters with white light emission due to phosphor converted excitation radiation radiated by the LED chips. Each LED chip may emit an individual color or radiation spectrum. Direct emitting LED chips without phosphor conversion and LED chips that employ phosphor-conversion may be used in various combinations and geometrical arrangements. A primary optic component (such as a lens or a collimation unit) may be attached to an LED chip or placed in front of an LED chip in order to shape the characteristics of the LED emission pattern. The LED chips may employ a joint primary optic.

The LED chips may be operated individually and/or operated grouped in arrangements containing a certain number of LED chips, or jointly altogether. The LED chips may be operated with different current levels and therefore different power levels and different radiation output.

The meaning of the term "LED" used in the description and claims is not restricted to light emitting diodes but also includes laser diodes and organic light emitting diodes (PLED) like Polymer organic light emitting diodes for example.

The lighting apparatus with the LED light source module according to the disclosure may be used for lighting purposes (for example headlighting, rear lighting, auxiliary lighting) for cars, trucks, buses, trains, bicycle, electrical bikes (E-Bikes), Trikes, Quads, on-road or off-road vehicles, electrically assisted wheelchairs, marine lighting, positional lighting, aeroplanes, helicopter, ships, and marine vessels. Furthermore, the LED light source module according to the disclosure may be used in a projection apparatus for entertainment purposes for example or in underwater lights, street lights, mining lights or in fixtures for general lighting.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

DESCRIPTION OF REFERENCE NUMERALS

1 LED light source module
2 LED light source
2*a* LED chip
2*b* LED supporting portion
2-1 First LED light source
2-2 Second LED light source
3 Heat sink
3*a* Flat plate portion
3*b* Fin
3*c* Side plate portion
3-1 First heat sink
3-2 Second heat sink
4 Electric fan unit
4*b* Casing body
4*a* Fan
5 Driver circuit
6 Attachment
6A Attachment main body
6B Supporting frame
11 LED light source module
12 LED light source module
13 LED light source module
14 LED light source module
15 LED light source module
21 LED light source
22 Substrate
23-1 First mounting surface
23-2 Second mounting surface
24-1 First LED chip
24-2 Second LED chip
31 LED light source
33 Substrate
33-1 First mounting surface
33-2 Second mounting surface
34-1 First LED chip
34-2 Second LED chip
41 LED light source
43 Substrate
43-1 First mounting surface
43-2 Second mounting surface
44-1 First LED chip
44-2 Second LED chip
51 Head light
52 Reflector
52*a* Reflecting surface
53 Light emitting opening
54 Light source mounting hole
55 Lens

What is claimed is:

1. A replaceable LED light source module for a lighting apparatus for a vehicle, comprising:

an LED light source having a single or a plurality of LED chips;

a heat sink thermally connected to the LED light source;

an electric fan unit cooling the heat sink by air blasting;

a driver circuit driving the LED light source and the electric fan unit; and an attachment detachably fitted into a light source mounting hole of the lighting apparatus for the vehicle, wherein all of the LED light source, the heat sink, the electric fan unit, the driver circuit, and the attachment are configured integrally, the LED light source is directly mounted on the heat sink, the heat sink is provided between the LED light source and the electric fan unit, the attachment has a supporting frame projecting into a lighting chamber, the electric fan unit is provided at a distal end portion of the supporting frame, the driver circuit is provided on the supporting frame, and all of the LED light source, the heat sink, the electric fan unit, and the driver circuit are housed in the lighting chamber through the light source mounting hole, wherein the heat sink and the driver circuit are adjacent to each other, and the heat sink has an internal flow passage designed such that air supplied from the electric fan unit can be guided to the driver circuit.

2. The LED light source module according to claim 1, wherein a stacking direction of the LED light source, the heat sink, and the electric fan unit is a diametrical direction of the attachment.

3. A replaceable LED light source module for a lighting apparatus for a vehicle, comprising:

an LED light source having a single or a plurality of LED chips;

a heat sink thermally connected to the LED light source;

an electric fan unit cooling the heat sink by air blasting;

a driver circuit driving the LED light source and the electric fan unit; and an attachment detachably fitted into a light source mounting hole of the lighting apparatus for the vehicle, wherein all of the LED light source, the heat sink, the electric fan unit, the driver circuit, and the attachment are configured integrally, the LED light source is directly mounted on the heat sink, the heat sink is provided between the LED light source and the electric fan unit, the attachment has a supporting frame projecting into a lighting chamber, the electric fan unit is provided at a distal end portion of the supporting frame, the driver circuit is provided on the supporting frame, and all of the LED light source, the heat sink, the electric fan unit, and the driver circuit are housed in the lighting chamber through the light source mounting hole, wherein the LED light source has a substrate joined to the heat sink, the substrate has a first mounting surface and a second mounting surface, the first mounting surface and the second mounting surface are different from each other in distance from the heat sink, a first LED chip is mounted on the first mounting surface, and a second LED chip is mounted on the second mounting surface.

4. A replaceable LED light source module for a lighting apparatus for a vehicle, comprising:

an LED light source having a single or a plurality of LED chips;

a heat sink thermally connected to the LED light source;

an electric fan unit cooling the heat sink by air blasting;

a driver circuit driving the LED light source and the electric fan unit; and an attachment detachably fitted into a light source mounting hole of the lighting apparatus for the vehicle, wherein all of the LED light source, the heat sink, the electric fan unit, the driver circuit, and the attachment are configured integrally, the LED light source is directly mounted on the heat sink, the heat sink is provided between the LED light source and the electric fan unit, the attachment has a supporting frame projecting into a lighting chamber, the electric fan unit is provided at a distal end portion of the supporting frame, the driver circuit is provided on the supporting frame, and all of the LED light source, the heat sink, the electric fan unit, and the driver circuit are housed in the lighting chamber through the light source mounting hole, wherein the LED light source has a substrate joined to the heat sink, the substrate has a first mounting surface and a second mounting surface, the first mounting surface is inclined toward the second mounting surface, a first LED chip is mounted on the first mounting surface, and a second LED chip is mounted on the second mounting surface.

5. A replaceable LED light source module for a lighting apparatus for a vehicle, comprising:

an LED light source having a single or a plurality of LED chips;

a heat sink thermally connected to the LED light source;

an electric fan unit cooling the heat sink by air blasting;

a driver circuit driving the LED light source and the electric fan unit; and an attachment detachably fitted into a light source mounting hole of the lighting apparatus for the vehicle, wherein all of the LED light source, the heat sink, the electric fan unit, the driver circuit, and the attachment are configured integrally, the LED light source is directly mounted on the heat sink, the heat sink is provided between the LED light source and the electric fan unit, the attachment has a supporting frame projecting into a lighting chamber, the electric fan unit is provided at a distal end portion of the supporting frame, the driver circuit is provided on the supporting frame, and all of the LED light source, the heat sink, the electric fan unit, and the driver circuit are housed in the lighting chamber through the light source mounting hole, wherein the heat sink is provided on both sides of the electric fan unit, and the LED light source is directly mounted on each of the heat sinks.

6. A replaceable LED light source module for a lighting apparatus for a vehicle, comprising:

an LED light source having a single or a plurality of LED chips;

a heat sink thermally connected to the LED light source;

an electric fan unit cooling the heat sink by air blasting;

a driver circuit driving the LED light source and the electric fan unit; and an attachment detachably fitted into a light source mounting hole of the lighting apparatus for the vehicle, wherein all of the LED light source, the heat sink, the electric fan unit, the driver circuit, and the attachment are configured integrally, the LED light source is directly mounted on the heat sink, the heat sink is provided between the LED light source and the electric fan unit, the attachment has a supporting frame projecting into a lighting chamber, the electric fan unit is provided at a distal end portion of the supporting frame, the driver circuit is provided on the supporting frame, and all of the LED light source, the heat sink, the electric fan unit, and the driver circuit are housed in the lighting chamber through the light source mounting hole wherein the heat sink and the driver circuit are adjacent to each other, and the heat sink has an internal flow passage designed such that air supplied from the electric fan unit can be guided to the driver circuit, wherein the attachment has a gasket for sealing the light source mounting hole.

* * * * *